US005586646A

United States Patent [19]

Bridgeman et al.

[11] Patent Number: 5,586,646

[45] Date of Patent: Dec. 24, 1996

[54] VEHICLE LOCKING SYSTEMS

[76] Inventors: Mark Bridgeman, 106 Kelsey Lane, Balsall Common, Coventry, United Kingdom, CV7 7GT; Pierre Periou, Fordhouse Lane, Stirchley, Birmingham, West Midlands B30 3BW, United Kingdom

[21] Appl. No.: 468,631

[22] Filed: Jun. 6, 1995

Related U.S. Application Data

[63] Continuation of Ser. No. 75,635, Jun. 11, 1993, abandoned.

[30] Foreign Application Priority Data

Jun. 16, 1992 [GB] United Kingdom ..... 9212768

[51] Int. Cl.[6] ..... H01H 15/06

[52] U.S. Cl. ..... 200/541; 200/540; 200/538

[58] Field of Search ..... 200/530, 537, 200/538, 540, 541, 531, 529, 252, 16 B, 547, 550, 549

[56] References Cited

U.S. PATENT DOCUMENTS

| | | | |
|---|---|---|---|
| 2,263,754 | 11/1941 | Batcheller | 200/531 |
| 3,096,112 | 7/1963 | Johnstone | 292/3 |
| 3,188,953 | 6/1965 | Bianosi | 200/537 |
| 3,211,154 | 10/1965 | Becker et al. | 200/541 |
| 3,857,008 | 12/1974 | Van Der Donk | 200/531 |
| 4,825,020 | 4/1989 | Rao et al. | 200/550 |
| 5,107,085 | 4/1994 | Roswold | 200/541 |

FOREIGN PATENT DOCUMENTS

| | | |
|---|---|---|
| 0064602 | 11/1982 | European Pat. Off. . |
| 0368290 | 5/1990 | European Pat. Off. . |
| 3534438 | 5/1987 | Germany . |
| 646241 | 11/1950 | United Kingdom . |
| PCT/ FR8700013 | 7/1987 | WIPO . |

*Primary Examiner*—David J. Walczak
*Attorney, Agent, or Firm*—Learman & McCulloch

[57] ABSTRACT

Actuator for an electrically operated vehicle door lock has an actuator plunger which is shiftable between first and second positions to lock and unlock the related door latch. The actuator plunger carries a resilient electrical contact element which coacts with one or more fixed contacts on a guide to close one or more respective circuits for operating other parts of the related system and/or signalling the condition of the related lock, such as whether it is locked or unlocked. Preferably the contacts slide into and out of engagement to provide silent operation and self-cleaning wiping action.

7 Claims, 2 Drawing Sheets

VEHICLE LOCKING SYSTEMS

This is a continuation of application Ser. No. 08/075,635 filed on Jun. 11, 1993, now abandoned.

BACKGROUND

This invention relates to vehicle door locking systems and more specifically to vehicle door lock actuator assemblies incorporating provision for electro-mechanical actuation and/or electro-mechanical sensing of the setting or condition of the mechanism, e.g. whether it is in locked or unlocked condition. Assemblies incorporating the invention will normally form part of a vehicle central door locking (CDL) system in which automatic positive locking of all the door latches of a vehicle from a single operation at a central point, typically in unison with the locking or unlocking of the latch assembly of the driver's or other door, takes place. CDL systems commonly use electro-mechanical actuators in or associated with the slave door latches to lock and unlock them automatically in response to electro-mechanical sensor switches on or relating to a master unit, e.g. the driver's door lock actuator assembly, through an electric or electronic control centre.

The object of the invention is to provide door lock actuator assemblies having built-in electrical switching which are of particularly simple and reliable construction, compact, easily assembled and maintained, economical to manufacture, and quiet in operation.

SUMMARY OF THE INVENTION

According to the invention there is provided a vehicle door lock actuator assembly including an actuator member selectively shiftable between first and second positions for or as a result of respective locking and unlocking of a door latch operatively related to the assembly, a first electrical switch contact element carried on said member for movement therewith, and a second electrical contact switch element located to co-act with the first element when the member is at a predetermined one of said positions to close an electrical circuit of the assembly for providing a signal to another part of the assembly or of a locking system of the vehicle of which the assembly operatively forms part indicating that the member is at said one position.

Conveniently the actuator member will be a plunger guided for reciprocation in a guide formation of the assembly and selectively driven by an electrically energised actuator motor of the assembly and/or by manual operation.

Said plunger and said contact elements may constitute a plunger action switch; preferably there will be a pair of separate second contact elements, the first contact element bridging them to close the circuit when the plunger is at said one position.

Third and possibly further contact elements may be provided forming part of further electrical circuits to be closed by the co-acting contact element or elements of the actuator member at either or both said positions and/or possibly at intermediate positions therebetween; typically a first circuit will be closed when the plunger or other actuator member is at the locked position leaving another circuit open, and the latter circuit will be closed and the first circuit open when the plunger or other actuator member is at the unlocked position.

It is also preferred that the contact elements engage and disengage with a sliding or wiping action for self-cleaning and quiet operation.

THE DRAWINGS

An example of the invention is now more particularly described with reference to the accompanying drawings wherein:

FIG. 1 is a longitudinal sectional view of a vehicle door actuator assembly, FIG. 2 is a diagrammatic enlarged detailed view of an actuator plunger and associated switch contact elements of the assembly, and FIG. 3 is a further enlarged view detailing a part of said plunger and an associated contact element.

DETAILED DESCRIPTION

Figure 1:
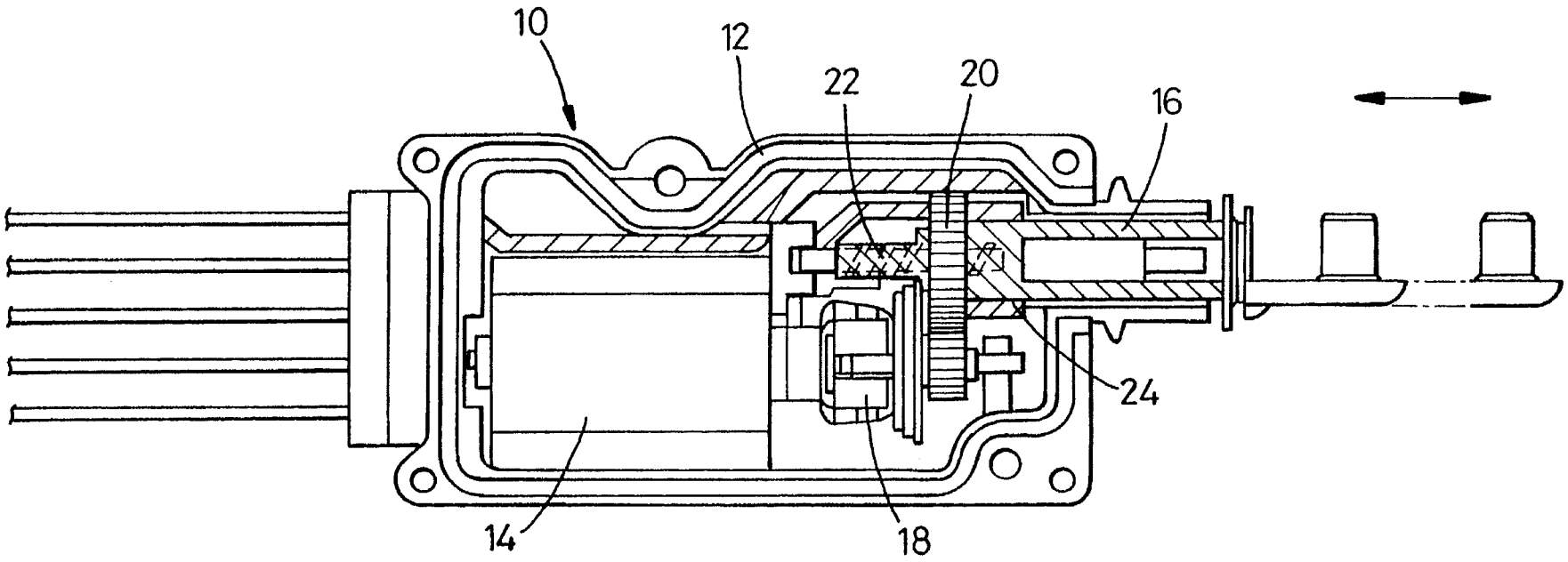

An electro-mechanical door lock actuator assembly 10 comprises a housing 12 (shown sectioned in FIG. 1) which also serves as a fixed mounting for the assembly containing a rotary electric motor 14 and associated electric circuit.

Housing 12 also locates and guides an actuator member in the form of a push-pull actuator plunger 16 which extends beyond one end of the housing for operative connection to linkage (not shown) of mechanical locking mechanism of the assembly of known kind (also not shown) for selectively securing the latch of the associated vehicle door in use. Said locking mechanism will also have provision for manual actuation, e.g. by an interior sill button or the like of the door and/or by key actuation from the exterior of the door.

When the locking mechanism is so manually actuated plunger 16 will be shifted rectilinearly relatively to housing 12 between locked and unlocked positions.

It can also be likewise shifted by operation of motor 14 to drive the locking mechanism between said conditions, rotary motion of the motor shaft being transmitted through a clutch unit 18 and gear train 20 to a wormscrew 22 forming part of or linked to plunger 16 for reciprocation thereof in known manner.

The assembly operatively forms part of a CDL system of the vehicle whereby all the doors (and possibly other closures of the vehicle body such as a boot lid, petrol cap and the like) are automatically simultaneously locked and unlocked in unison as referred to above. For this purpose the actuator assembly of each door lock will include electrical switching means best seen in FIGS. 2 and 3.

The inner end of plunger 16 mounts a U-shaped metal strip or moving switch contact element 24 having generally parallel limbs 26 that extend along opposite sides of plunger 16 and the connecting portion 28 passing through the inner extremity of the plunger to secure contact element 24 thereto. Further security is provided by the free end of each limb 26 being bent inwards to engage in a slot in the plunger wall.

The ends of the main part of each limb 26 abut rounded fulcrums or cross ridges 30 (FIG. 3) formed on the plunger side face so that the intermediate parts of the limbs are free to flex laterally of the plunger. A central portion of each limb is crimped to form a laterally projecting contact nib 32, the two nibs being opposite each other.

Figure 2:
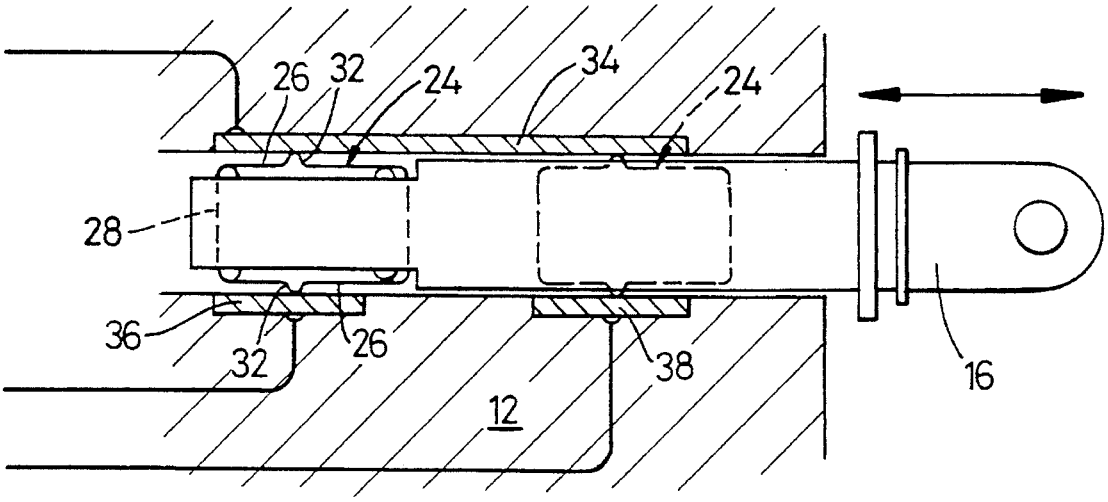
Figure 3:
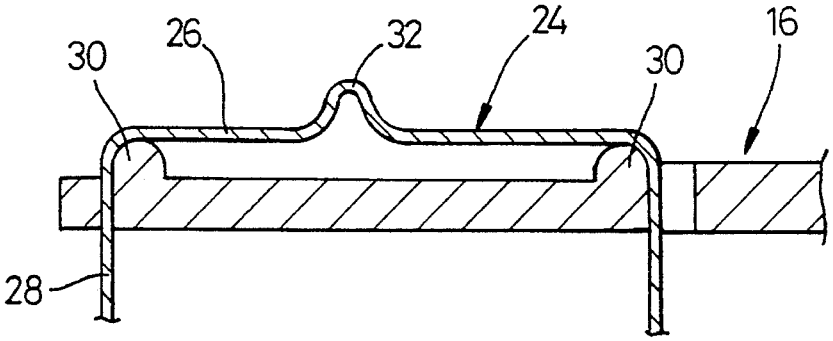

The guide formation of housing 12 in which plunger 16 moves is provided with three separate static switch contact elements; a long element 34 in the upper wall of the guide as viewed in FIG. 2 and extending beyond the full range of movement of element 24 in company with plunger 16 in its travel between the locked and unlocked positions, and a pair of static short contact elements 36 and 38 spaced apart longitudinally of said range of travel in the lower wall of the guide.

The three elements 34, 36 and 38 are all electrically insulated from each other by the plastics material from which housing 12 is moulded. Plunger 16 is also a plastics moulding and thus does not itself provide any connection between said elements.

With the mechanism in the locked condition plunger 16 is at the innermost position shown in full lines in FIGS. 1 and 2 and, at this position, moving contact element 24 bridges static contact element 34 (which is common to two circuits of the assembly) and the innermost lower static element 36 so closing a first circuit and providing a signal that this particular actuator is in its locked condition. Said signal may be utilized to activate the actuators of the other door locks of the CDL system so that they are shifted to locked condition simultaneously, and/or to provide a visual or other signal to the user or to other related equipment.

When plunger 16 is displaced to its outer unlocked position contact element 24 will take up the position shown in broken lines in FIG. 2 bridging contact element 34 and the outermost lower contact element 38. This will open the first circuit and close a second circuit providing a signal that this actuator is in the unlocked condition and again this can be applied for activation of other actuators in the system likewise and/or for providing a visual or other signal to the user of the vehicle that a door or doors are not locked.

The arrangement in which each limb 26 bridges the gap between ridges 30 allows the limb to flex so that the contact nib 32 is urged into positive sliding and wiping engagement with the static contact elements. This provides certain and effective electrical contact with the further advantage that the sliding movement will tend to keep the contact areas clean and free of corrosion.

The switching arrangement described above is of simple and reliable construction and enables the manufacture and assembly of a particularly compact actuator, the switch contacts occupy practically no extra space within the housing and do not add to the number of moving parts. The arrangement replaces the micro-switches previously commonly used in such assemblies thus reducing manufacturing costs, electrical connections and wiring, and saving the space such switches would otherwise occupy. Moreover the snap action of micro-switches is noisy (the contacts described above will operate silently) and they are not always reliable particularly under the arduous conditions to which they are subjected in vehicle assemblies.

It will be appreciated that for some applications only a single-way on/off switch may be required in which case one of the lower short contact elements 36 or 38 would be omitted and a single circuit would be opened and closed by movement of the plunger. In yet other applications further contacts and related circuits might be included, for example a third short lower element might be added between elements 36 and 38 to energize a related circuit when the plunger was at an intermediate position, for example to provide a warning that a door was not fully latched or locked. Other variations in the arrangement of contact elements and related circuitry will be apparent to those skilled in the art.

We claim:

1. An actuator assembly for an electrically operated vehicle door lock comprising:

means forming a guide for an actuator plunger;

a push-pull action actuator plunger slideably received between and located by opposing side walls of said guide for inward and outward movement between first and second positions relative to said guide;

a first electrical contact element carried by said plunger for movement therewith; and at least one separate, second electrical contact element mounted on a said side wall of said plunger guide and so positioned relative to said first contact element as to engage said first contact element when said plunger is moved to a predetermined one of said first and second positions, said first contact element comprising a generally U-shaped resilient metal strip having spaced apart, parallel limbs extending along opposite side faces of the plunger and a connecting portion passing through the plunger whereby the first contact element is coupled to said plunger, an intermediate portion of each said limb being supported in spaced relation to said plunger and being deformable toward the respective plunger side face upon engagement with said second contact element.

2. The assembly of claim 1 wherein each said plunger side face includes a pair of longitudinally spaced cross ridges supporting the respective said intermediate portion and forming rounded fulcrums adjacent the ends of said limb portions.

3. The assembly of claim 1 wherein said intermediate portion has a central region deformed away from said plunger to provide a laterally projecting contact rib.

4. The assembly of claim 1 wherein said second contact element has separate portions so positioned relative to one another and to said first contact element as to be bridged by said first contact element when said plunger is moved to said predetermined one of said positions.

5. The assembly of claim 4 wherein said plunger guide mounts at least one additional electrical contact element so positioned relative to one of said portions of said second contact element as to be bridged by said first contact element when said plunger is moved to the second of said positions.

6. The assembly of claim 1 wherein said plunger has a portion thereof projecting beyond one end of said plunger guide, said portion having means for connecting said plunger to a door latch assembly.

7. The assembly of claim 1 including a motor coupled to said plunger, said motor being operative to drive said plunger selectively between said first and second positions.

* * * * *